US007336165B2

(12) United States Patent
Fuchs

(10) Patent No.: US 7,336,165 B2
(45) Date of Patent: Feb. 26, 2008

(54) RETROFITTING DETECTORS INTO LEGACY DETECTOR SYSTEMS

(76) Inventor: Andrew M. Fuchs, 73 Collins Ave., Bloomfield, NJ (US) 07003

( * ) Notice: Subject to any disclaimer, the term of this patent is extended or adjusted under 35 U.S.C. 154(b) by 340 days.

(21) Appl. No.: 11/037,955

(22) Filed: Jan. 18, 2005

(65) Prior Publication Data

US 2006/0158327 A1 Jul. 20, 2006

(51) Int. Cl.
*G08B 29/00* (2006.01)

(52) U.S. Cl. ..... 340/506; 340/568.2; 340/693.6; 361/67

(58) Field of Classification Search ..... 340/506, 340/501, 505, 508, 531, 511, 514, 533, 568.2, 340/572.3, 655–664, 693.6, 693.11; 361/1, 361/62, 63, 67
See application file for complete search history.

(56) References Cited

U.S. PATENT DOCUMENTS

| | | | | | |
|---|---|---|---|---|---|
| 3,767,917 | A | | 10/1973 | Lampart et al. | 250/384 |
| 3,900,795 | A | * | 8/1975 | Larsen et al. | 324/537 |
| 4,315,594 | A | | 2/1982 | Niederost | 340/693.11 |
| 4,389,635 | A | | 6/1983 | Gallagher | 240/287 |
| 4,424,553 | A | | 1/1984 | Marsocci et al. | 361/825 |
| 4,929,187 | A | | 5/1990 | Hudson et al. | 439/334 |
| 5,478,256 | A | | 12/1995 | Koganemaru et al. | 439/507 |
| 5,659,293 | A | | 8/1997 | Shibata et al. | 340/628 |
| 5,705,979 | A | * | 1/1998 | Fierro et al. | 340/517 |
| 5,710,541 | A | | 1/1998 | Stanley et al. | 340/628 |
| 5,805,071 | A | | 9/1998 | Hur | 340/693.9 |
| 5,914,665 | A | | 6/1999 | Thorp et al. | 340/691.1 |
| 5,969,627 | A | | 10/1999 | Tarlton et al. | 340/693.12 |
| 6,057,778 | A | * | 5/2000 | Davidson | 340/693.5 |
| 6,114,967 | A | * | 9/2000 | Yousif | 340/690 |
| 6,133,843 | A | | 10/2000 | Davidson | 340/693.9 |
| 6,271,763 | B1 | | 8/2001 | Hur | 340/693.12 |
| 6,273,388 | B1 | | 8/2001 | Capaldi-Tallon | 248/343 |
| 6,323,780 | B1 | | 11/2001 | Morris | 340/692 |
| 6,731,207 | B1 | * | 5/2004 | Swieboda et al. | 340/501 |
| 6,737,977 | B2 | * | 5/2004 | Nishikawa et al. | 340/628 |
| 7,034,702 | B2 | * | 4/2006 | Thomas et al. | 340/628 |
| 7,064,269 | B2 | * | 6/2006 | Smith | 174/50 |
| 7,109,874 | B2 | * | 9/2006 | Pilkington | 340/628 |

(Continued)

OTHER PUBLICATIONS

Eight (8) Miscellaneous Sheets of Edwards Systems Technology Literature, Undated.

(Continued)

*Primary Examiner*—Benjamin C. Lee
*Assistant Examiner*—Daniel Previl
(74) *Attorney, Agent, or Firm*—The Patent Source

(57) ABSTRACT

The disclosure includes improvements in the field of retrofit-detector installation such as adapters that simplify retrofit of addressable detectors onto previously installed zone-type system hardware. Each adapter includes electrical circuitry for electrically connecting new addressable detectors with legacy system once installation is complete. The disclosure includes structures that permit users to efficiently solve a number of problems that may arise during installation of retrofit-detectors into legacy systems. For example, one or more switches may be used to reverse electrical polarity to thereby correct polarity and/or mapping faults. One or more switches may also be provided to disconnect at least one electrical terminal to assist in locating ground faults and/or other wiring problems. One or more test points may also be provided to test one or more electrical characteristics relevant to retrofit installations.

20 Claims, 6 Drawing Sheets

U.S. PATENT DOCUMENTS

| | | | | |
|---|---|---|---|---|
| 2001/0038336 | A1 | 11/2001 | Acevedo | 340/628 |
| 2003/0080865 | A1 | 5/2003 | Capowski et al. | 340/506 |
| 2003/0107495 | A1 | 6/2003 | Swieboda et al. | 340/693.5 |

OTHER PUBLICATIONS

PCT International Search Report; Notification of Transmittal of International Search Report . . . ; and Written Opinion of the International Searching Authority; all for International Application PCT/US06/01150, dated Apr. 30, 2007 (12 pages total).

PCT Notification Concerning Transmittal Of Copy Of International Preliminary Report On Patentability; International Preliminary Report On Patentability; and Written Opinion Of The International Searching Authority; all for International Application PCT/US06/01150, dated Aug. 2, 2007 (8 pages total).

* cited by examiner

RETROFITTING DETECTORS INTO LEGACY DETECTOR SYSTEMS

BACKGROUND OF THE INVENTION

1. Field of the Invention

The present invention is directed to systems, methods, apparatus and related components that facilitate the installation of new detectors into legacy detector systems. More particularly, the invention relates to facilitating the conversion of zone-type heat, fire and/or smoke detector systems to addressable heat, fire and/or smoke detector systems. Accordingly, the general objects of the invention are to provide novel systems, methods and apparatus of such character.

2. Description of the Related Art

Heat, fire and smoke detectors/alarms have been widely installed in both commercial and residential structures to protect their inhabitants and other contents for many years. Since these building often last much longer than detector and alarm technologies, there are currently many older buildings that are equipped with technologically outdated protection systems. One particularly common protection system technology that has become outdated is that of the zone-type system. Since an understanding of zone-type systems is helpful in appreciating certain aspects of the present invention, however, a discussion of zone-type systems follows.

A representative zone-type protection system 10 is illustrated in FIG. 1. As shown therein, a conventional zone-type system uses plural heat, fire or smoke detectors 9, 9' configured in a so-called detector loop 13 that terminates at and is electrically coupled to a control panel 11. In such a system, each detector loop 13 typically comprises plural wires (most often a pair of wires) that have been strung through various locations during the construction of a structure. Each detector loop is electrically coupled to a number of detectors 9, 9' with an end-of-line resistor at one end and a control panel 11 to the other. A typical industrial zone-type system may include hundreds of detectors arranged in several zones (each of which may have one or more loops). Subsequent completion of the structure hides these loops from access except where the wiring is connected to a detector or control panel.

The detectors used in the above-noted systems are generally of the following three types: flame detector, thermal detector, or smoke detector. These three classes of detectors correspond to the three primary properties of a fire: flame, heat, and smoke and may be designed to sense smoke obscuration, ionization, temperature, or the like, all of which may be indicative of a fire. Conventional zone-type detector assemblies of the type used in the system 10 of FIG. 1, typically include a base 20 (as shown in FIG. 2) and a complementary detector (not shown). Conventional zone-type detector base 20 generally includes a body 21 with a detector-mating rim 25, at least two mounting apertures and a plurality of electrical terminals 22*a* through 22*d*. During installation of base 20, body 21 is affixed to the surface of a wired building via the mounting apertures and the detector loop wiring is hardwired to terminals 22*a* through 22*d*. For example, a pair wires from an incoming leg of a detector loop may be connected to terminals 22*a* and 22*b* as shown in FIG. 1 and as known in the art. Similarly a pair of wires for a downstream leg of the detector loop may be connected to terminals 22*c* and 22*d* as shown in FIG. 1 and as known in the art. It will be appreciated that the desired electrical circuitry will be completed by mating a conventional zone-type detector onto, now mounted, base 20 as is known in the art. In this way, each zone-type detector is electrically connected to the detector loop via the electrical connections within base 20.

A typical zone-type detector is designed to operate in an on/off mode by changing from an inactive state to an active state whenever the environmental condition that the detector is designed to monitor exceeds a predetermined threshold. In the active state, the internal resistance of the detector is lowered, thereby increasing the current flow through the detector loop. Control panel 11 provides the operating current for the detector loop and includes a current sensing mechanism communicatively linked to the detector loop. When the current flow level in the detector loop exceeds a predetermined threshold, control panel 11 activates an alarm and/or discharges a fire suppressant such as water, halon, etc. as is known in the art.

While such zone-type systems offer some advantages over older systems, one of their deficiencies was that they could only direct users' attention to the zone in which an emergency condition was detected (as opposed to the precise location of the detected emergency condition). This deficiency was solved with the introduction of more sophisticated detector systems with a control panel that is communicatively linked to microprocessor-based "addressable" detector assemblies of the type shown in exploded view in FIGS. 3*a* and 3*b*. As known, detector 12 preferably reports alarm conditions via radio transmission to a control panel.

Like zone-type detector assemblies 9, addressable detector assemblies 12 typically include a base 20' and a complementary detector 30. Detector 30 includes electrical terminals 32*a*, 32*b*, 32*c* and 32*d* and a body with a rim 35. Base 20' includes a body 21' with a pair of surface mounting apertures and a rim 25' designed to mate with rim 35 of detector 30. Base 20' further includes electrical terminals 22*a*', 22*b*', 22*c*' and 22*d*'. In use, terminals 22*a*' through 22*d*' are hardwired directly to detector loop wiring 13 and are also electrically coupled to respective terminals 32*a* through 32*d* of detector 30 as is known in the art.

Several examples of the above-discussed addressable detector assemblies include those in the "Signature Series" produced and sold by Edwards Systems Technology of Cheshire, Conn. under the designations "SIGA-PS," "SIGA-AB4," "SIGA-IB," and "SIGA-RB." Other examples of addressable detectors are well known in the art.

Addressable detectors of the type discussed above represent an advance in that each detector 12 has the ability to report its location when communicating the presence of an emergency condition. Further, they may produce signals that they are capable of indicating the magnitude of the parameters being sensed, rather than just active-inactive signals. The addressable system control panel, which is typically microprocessor-based and under software control, analyzes the information transmitted from detector assembly 12 to determine whether an alarm condition exists and, if so, where the reporting detector is located.

For these and other reasons, addressable systems have, essentially replaced zone-type systems in new installation applications. Additionally, many previously installed zone-type systems are being upgraded with addressable detectors and control panels specifically designed to retrofit zone-type systems. Since such retrofit systems utilize the legacy detector loop wiring 13 from the zone-type system 10, they are substantially less expensive than installation of a completely new addressable system.

In a typical retrofit application, addressable detector assembly 12 would be retrofit into a zone-type system by removing zone-type detector assembly 9' and connecting base 20' to the existing detector loop wiring 13. In particular, legacy detector assembly 9 would be disconnected from its associated legacy wiring 13 and removed from the building to which it was affixed. Addressable base 20' is then affixed to a desired location (typically the same location as the newly removed zone-type base) and electrically connected to the, newly disconnected, legacy wiring 13. Further, addressable detector 30 is mated with addressable base 20' such that detector 30 is electrically connected to the legacy detector loop wiring 13 via base 20'.

If necessary, one may manually disconnect an end of line device from the initiating circuit, to permit the existing circuit to accept new addressable devices. Often the location of this device is unknown, as it is traditionally mounted behind an existing device in the electrical junction box. Nonetheless, conventional retrofit applications sometimes require identification and removal of such end of line devices. This is normally a difficult and labor-intensive step.

Although retrofit applications of the nature described above are less expensive than new installations, they are still labor-intensive, complicated and expensive endeavors that rely heavily on skilled technicians. For example, most retrofit projects involve manual removal of every zone-type detector from its location and from its associated wiring, testing of the wiring leading throughout each zone and to each detector, diagnosis of certain wiring problems and/or conditions, and manual connection and affixation of the new addressable detectors. Among the most common of such problems are (1) reverse polarity wiring; (2) ground faults; and (3) a need to disconnect an end-of-line device. Furthermore, the facts that (1) every building is different; (2) a wide range of detector systems have been used throughout the years; and (3) customer preferences vary from project to project, make each retrofit project unique. Thus, installation decisions must be made on the fly and unanticipated problems solved during installation. It will be readily appreciated that highly skilled technicians are required to perform this complex set of tasks. Such technicians are costly, in short supply and difficult to train. It will also be appreciated that retrofit projects of the type discussed above necessarily interfere with normal operations of the buildings (typically housing businesses) in which they occur. It is, therefore, highly desirable to minimize the time for implementing retrofit upgrades.

There is, accordingly, a need in the art for improved methods, systems and apparatus to facilitate conversion of zone-type systems into addressable systems. In particular, such methods and apparatus should envision simplified apparatus and techniques for integrating addressable detectors into legacy zone-type system hardware. Such methods, systems and apparatus will ideally offer users/purchasers an optimal combination of (1) simplicity; (2) reliability; (3) economy; and (4) versatility.

There is a further need in that art for improved methods and apparatus for converting zone-type systems into addressable systems that are capable of solving a variety of common problems associated with retrofit installations such as (1) reverse polarity wiring; (2) ground faults; and (3) a need to disconnect an end-of-line device.

SUMMARY OF THE INVENTION

The present invention satisfies the above-stated needs and overcomes the above-stated and other deficiencies of the related art by providing improved methods, systems and apparatus for enabling addressable detector assemblies to be installed directly onto previously wired zone-type detector bases. Thus, the invention obviates the need for and use of conventional addressable detector bases during conversion of zone-type systems into addressable systems. Further, the invention also obviates the need to remove zone-type detector bases during conversion of zone-type systems into addressable systems. The invention also eliminates the need to manually hardwire addressable detector assemblies and/or bases into the legacy detector loop wiring during conversion of zone-type systems into addressable systems. Moreover, preferred aspects of the invention permit certain troubleshooting tasks to be readily and conveniently performed. Additionally, such methods and apparatus offer an optimal combination of (1) simplicity; (2) reliability; (3) economy; and (4) versatility.

One form of the invention relates to improvements in retrofit-detector installation and, in particular, adapters that permit addressable detectors to be mounted onto previously installed zone-type detector bases. The inventive adapters simplify addressable detector installation and include a set of electrical contacts electrically linking newly installed detectors to legacy bases and detector loop wiring once installation is complete.

One optional feature of the preferred embodiment of the invention envisions the use one or more switches that solve a number of common installation problems. These may include (1) reverse polarity wiring; (2) ground faults; and (3) a need to disconnect an end-of-line device. For example, the inventive adapters may include one or more manual switches to reverse input and/or output wiring (e.g., reverse the polarity of either an individual detector or a branch of a given circuit), to thereby correct polarity and/or mapping faults. Another optional feature of a preferred embodiment envisions the use of one or more switches that may be used to disconnect one or more of the electrical paths through an adapter to thereby assist in locating ground faults and/or other wiring problems.

In a related form, the present invention is directed to improved methods to facilitate installation of addressable detectors into legacy zone-type system hardware to thereby facilitate conversion of zone-type systems into addressable systems.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1:
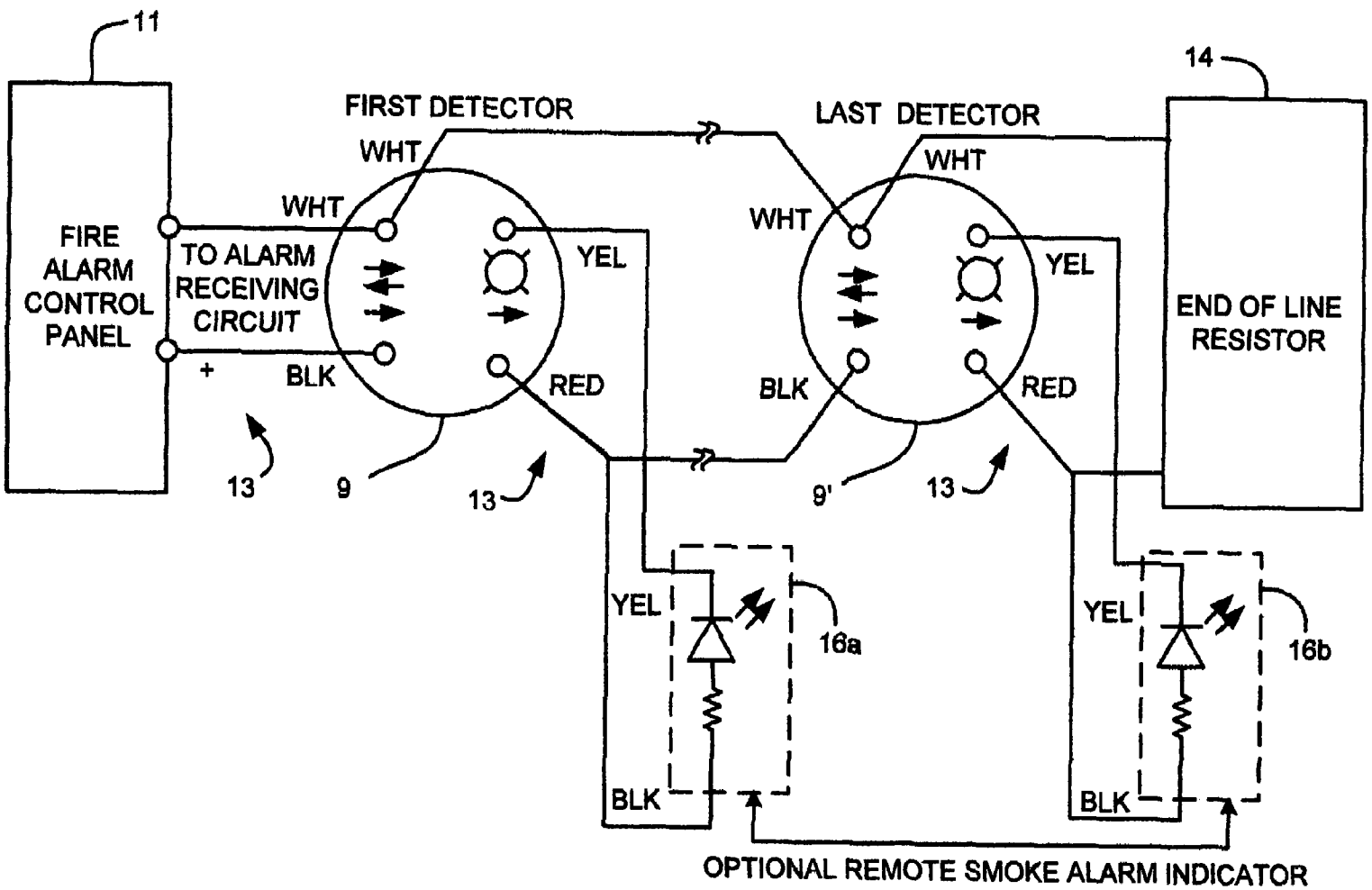
Figure 1 Prior Art
FIG. 1 illustrates a representative zone-type detector system in accordance with the prior art.
Figure 3B:
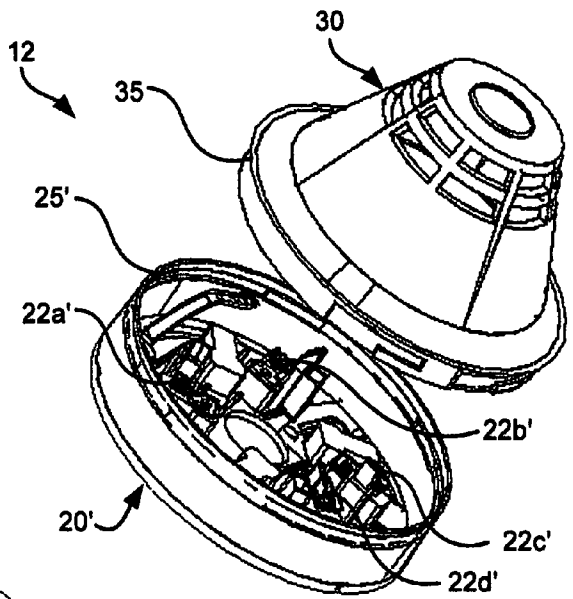
Figure 3b Prior Art
FIG. 3*b* is a second exploded view an addressable detector assembly in accordance with the prior art.
Figure 2:
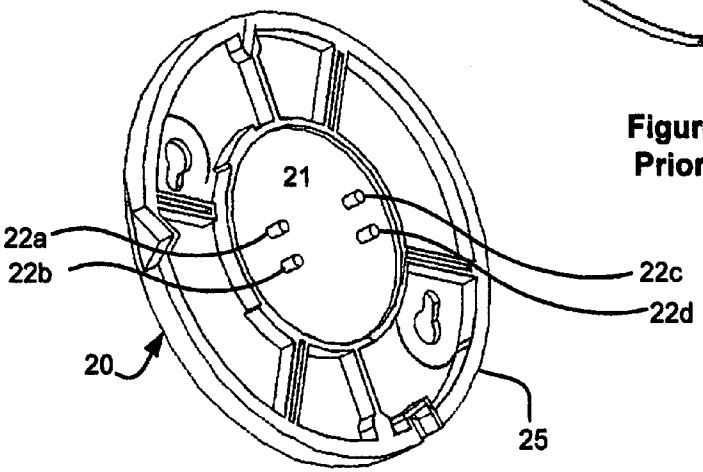
Figure 2 Prior Art
FIG. 2 illustrates a representative zone-type detector base in accordance with the prior art, the base of FIG. 2 being used in the system of FIG. 1.
Figure 3A:
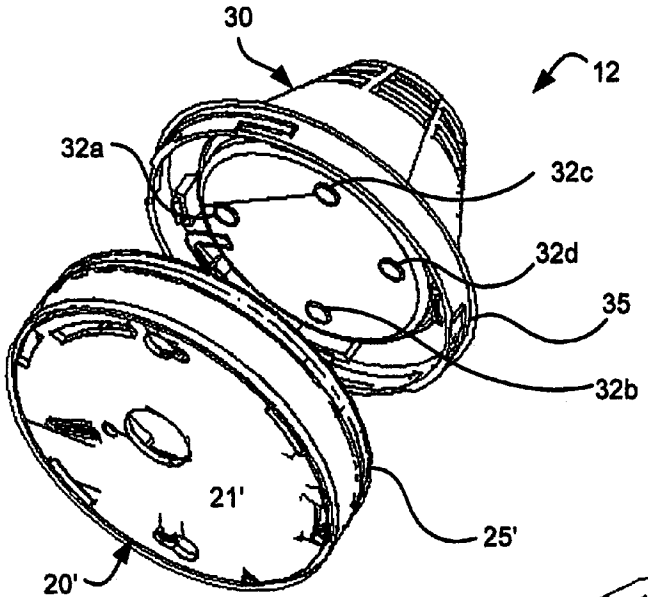
Figure 3a Prior Art
FIG. 3*a* is a first exploded view of an addressable detector assembly in accordance with the prior art.
Figure 4A:
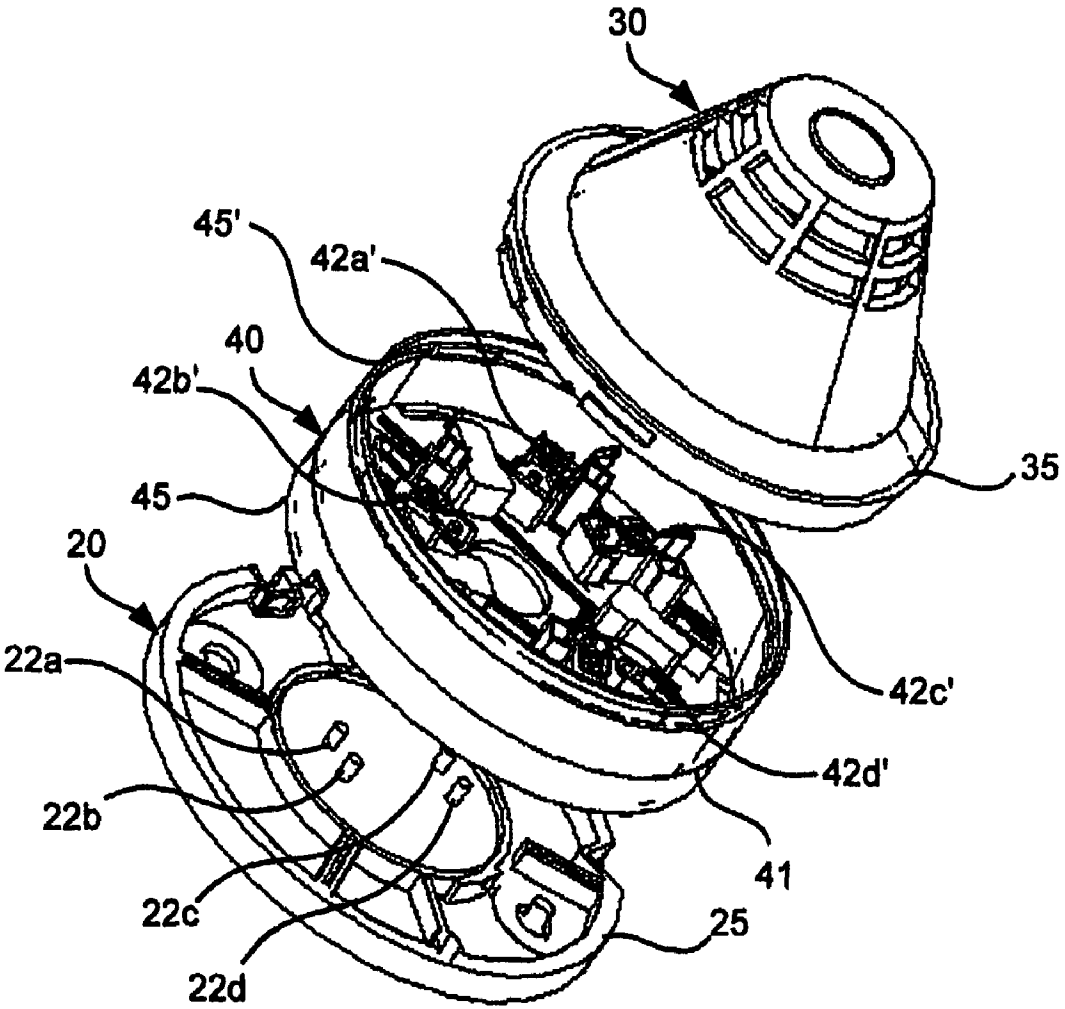
FIG. 4*a* depicts an inventive adapter in accordance with one preferred embodiment of the present invention, the adapter being shown in conjunction with a zone-type base and an addressable detector.
Figure 4B:
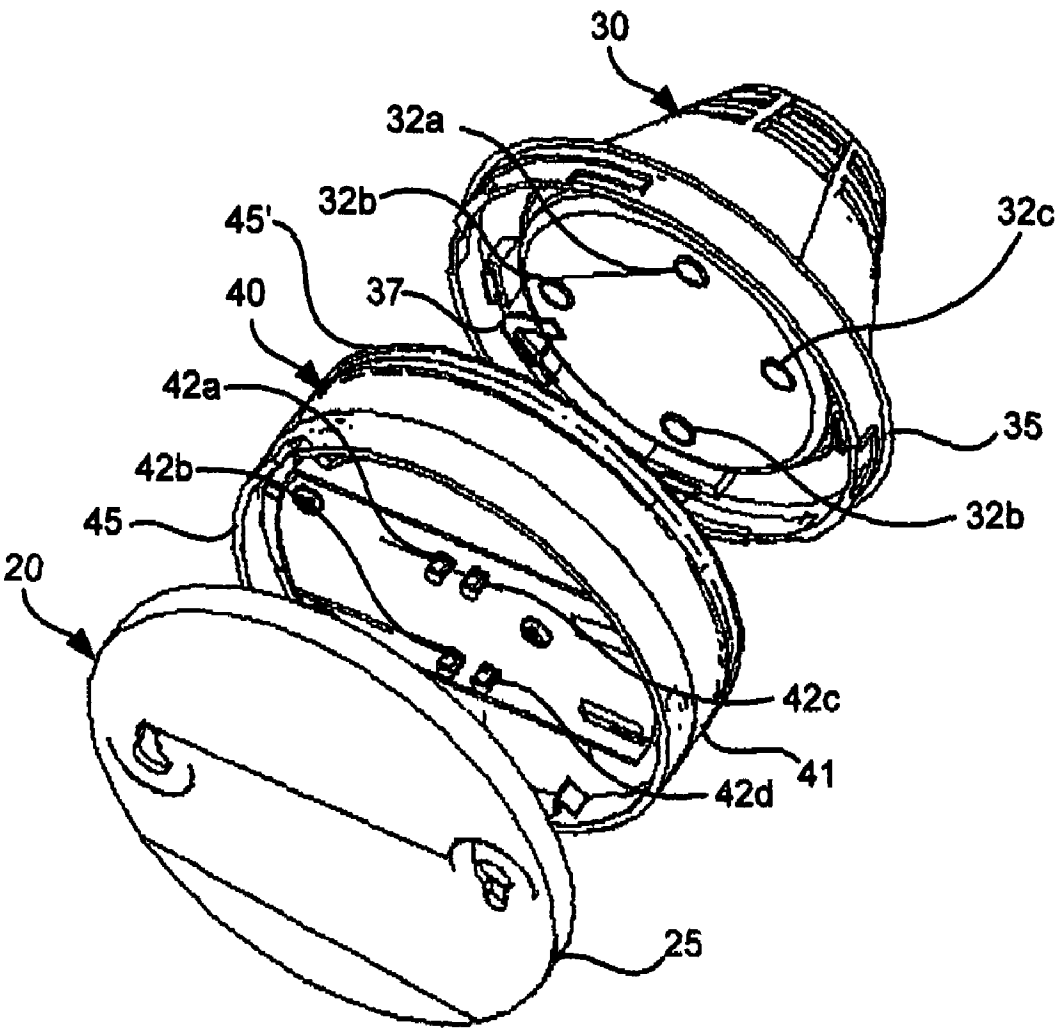
FIG. 4*b* is another view of the inventive adapter, zone-type base and addressable detector depicted in FIG. 4*a;*

An inventive adapter in accordance with one preferred embodiment of the present invention is shown in FIGS. 4*a* and 4*b*. As shown therein, an inventive adapter 40 is designed for use with a conventional zone-type base 20 and a conventional addressable detector 30. Adapter 40 preferably includes a body 41 with opposing rims 45 and 45' that are designed to mate with base 20 and detector 30 respectively. Adapter 40 further includes electrical terminals 42*a,* 42*b,* 42*c* and 42*d,* which are designed to electrically engage terminals 22*a,* 22*b,* 22*c* and 22*d* of base 20 respectively. Adapter 40 further includes electrical terminals 42*a'*, 42*b'*, 42*c'* and 42*d'*, which are designed to electrically engage electrical terminals 32*a,* 32*b,* 32*c,* and 32*d* of detector 30 respectively. However, it will be understood that terminals 42*c'*, 42*d'*, 32*c* and 32*d* are not necessary for functionality and, hence, may be disconnected or otherwise rendered non-functional.

In use, rim 45 of adapter 40 is mated with rim 25 of base 20 to thereby establish the aforementioned electrical connections between adapter 40 and base 20. Because base 20 has remained hardwired into detector loop wiring 13 since its original installation, terminals 42*a* through 42*d* are also electrically coupled to the detector loop wiring 13 via base terminals 22*a* through 2*d*. Similarly, in use, rim 35 of detector 30 is mated with rim 45' of adapter 40 to thereby establish the aforementioned electrical connections between adapter 40 and detector 40. In addition to the aforementioned structures, a tamper resistant structure may also be formed from the engagement of tab 47 of adapter 40 (see FIG. 5*b*) and tab 37 of base 30 (see FIG. 4*b*).

Figure 5B:
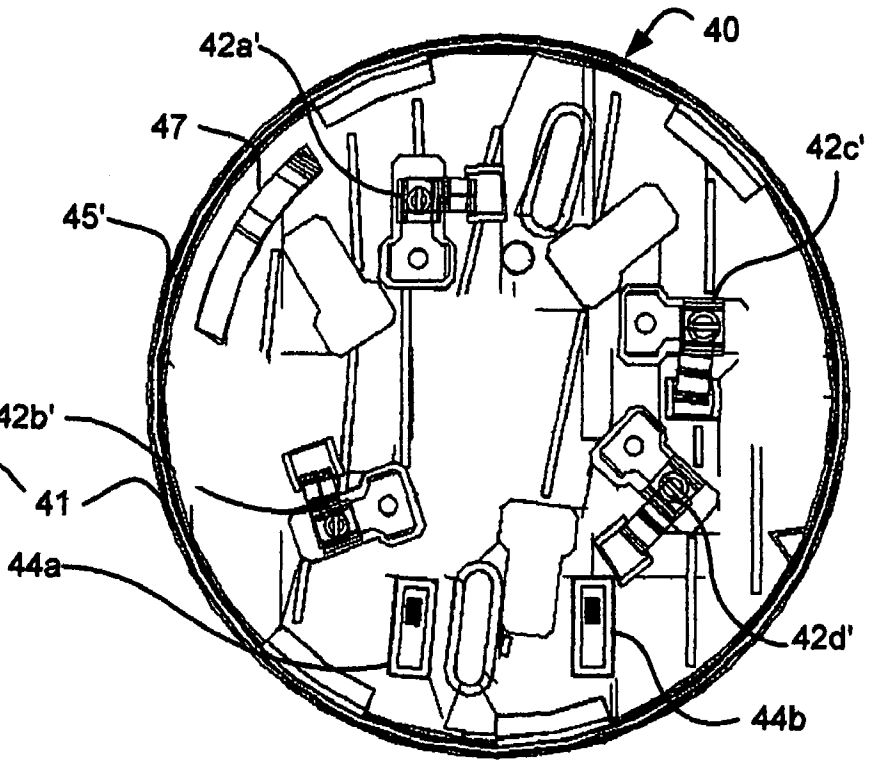
FIG. 5*b* is a detailed rear view of the inventive adapter of FIGS. 4*a* through 5*a;*
Figure 5A:
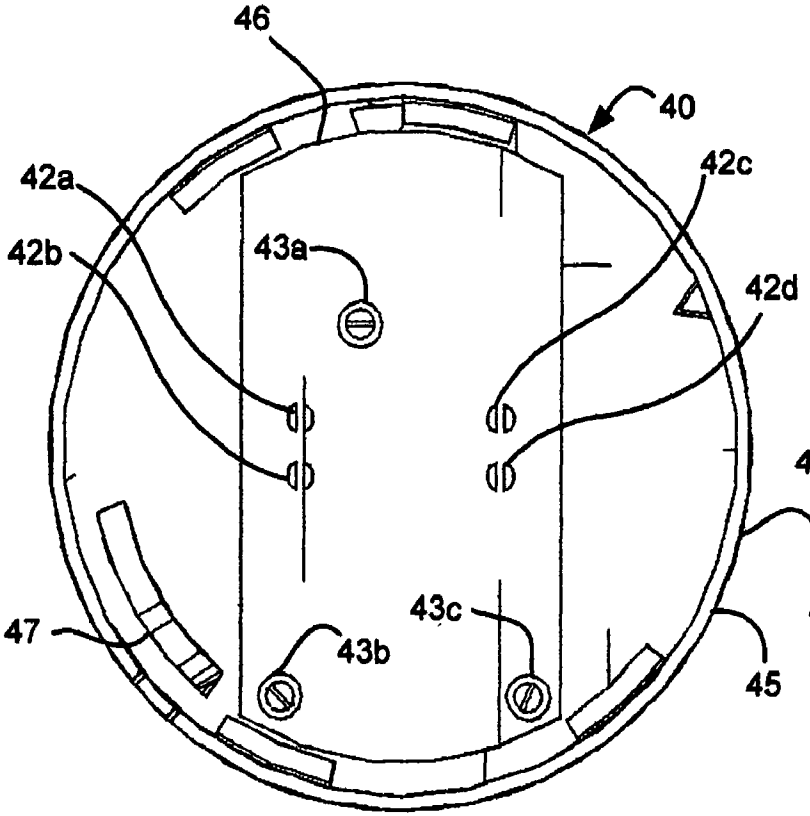
FIG. 5*a* is a detailed front view of the inventive adapter of FIGS. 4*a* and 4*b;*
Figure 6A:
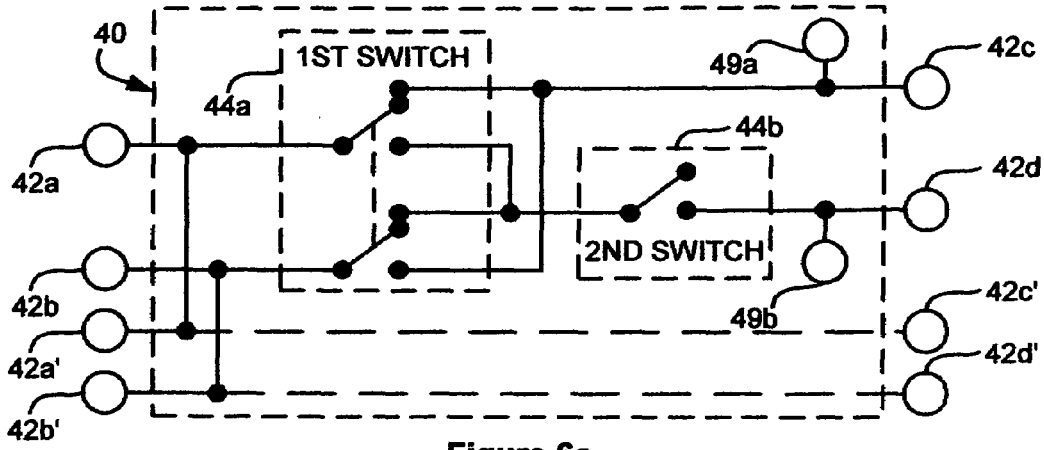
FIG. 6*a* is a schematic representation of the inventive adapter of FIGS. 4*a* through 5*b:*

With additional reference now to the detailed front and rear views of FIGS. 5*a* and 5*b,* it will be better appreciated that terminals 42*a* through 42*d* and 42*a'* through 42*d'* are preferably electrically coupled via circuitry concealed within body 41. In particular, body 41 preferably includes a cover 46 mounted via screws 43*a* through 43*c* to thereby enclose circuitry that is schematically depicted in FIG. 6*a* and discussed in greater detail below. This circuitry preferably includes a first switch 44*a* for selectively reversing the polarity of electricity presented to the terminals of base 20. This may be useful, for example, where the detector loop wiring was originally incorrectly hardwired onto base 20. As shown, first switch 44*a* is preferably accessible to a user after adapter 40 has been mated with base 20. This permits a user to conveniently diagnose and correct polarity problems encountered after adapter 40 has been affixed to base 20. Significantly, this can occur without disassembling any components and cannot be readily changed after a detector has been mated with an adapter. If there are no problems, or if they have been corrected, detector 30 can then be affixed to adapter 40 with confidence that proper operation will result without additional difficulty.

Similarly, a second switch 44*b* for selectively disconnecting the connection between at least one of terminals 42*a* and 42*b* from detector loop wiring 13 is preferably included in adapter 40 such that switch 44*b* is accessible after adapter 40 has been mated with base 20. This also permits a user to conveniently diagnose and correct problems encountered after adapter 40 has been affixed to base 20. For example, a user may use switch 44*b* to selectively prevent detector loop current from flowing to terminal 42*d* to thereby disconnect an end of line device if desired. Significantly, this can occur without disassembling any components and cannot be readily changed after a detector has been mated with an adapter. If there are no problems, or if they have been corrected, detector 30 can then be affixed to adapter 40 with confidence that proper operation will result without additional difficulty.

Turning primarily now to FIG. 6*a,* there is shown therein a schematic representation of adapter 40 of FIGS. 4*a* through 5*b* including the aforementioned terminals, switches and the, preferably enclosed, circuitry. As shown therein, adapter 40 includes circuitry electrically coupling terminals 42*a* and 42*b* with terminals 42*c,* 42*d,* and 42*a'* through 42*d'*. The circuitry preferably includes a single-pull double-throw switch that reverses the polarity of signals presented at terminals 42*c* and 42*d* if second switch 44*b* is closed. Further, the circuitry preferably includes a single-pull single-throw switch that disconnects terminal 42*b'* from the remainder of the detector loop if desired. Effectively, this can be used to disconnect a legacy end of line resistor. An additional, preferable feature is the provision of testing points, or test terminals, 49*a* and 49*b* that are exposed for access after an adapter has been mated with a base. In an alternative embodiment, not shown, terminals 42*c'* and 42*d'* may be replaced with test points 49*a* and 49*b*.

Figure 6B:
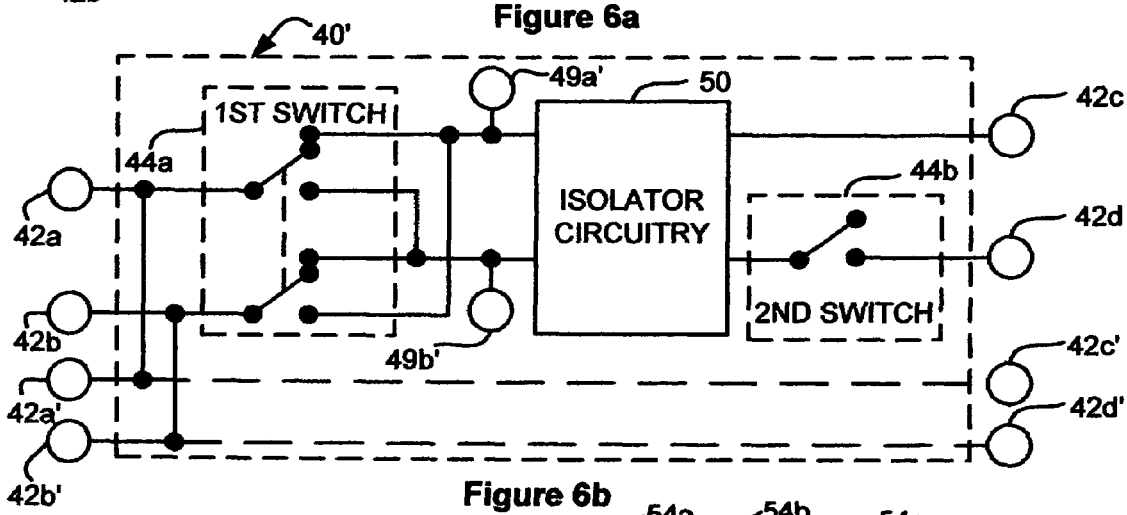
FIG. 6*b* is a schematic representation of an inventive adapter in accordance with an alternative embodiment of the present invention.

Turning now to the schematic representation of an alternative adapter 40' shown in FIG. 6*b,* one may see that alternative adapter 40' preferably includes an isolator circuit 50 which is preferably in the form of a line fault isolator for use on class A circuits. Isolator circuit 50 may be desirable to prevent or eliminate ground loops issues that may exist in the detector loop. Further, test points 49*a'* and 49*b'* are provided at points in the circuit that are isolated via isolator 50.

Figure 6C:
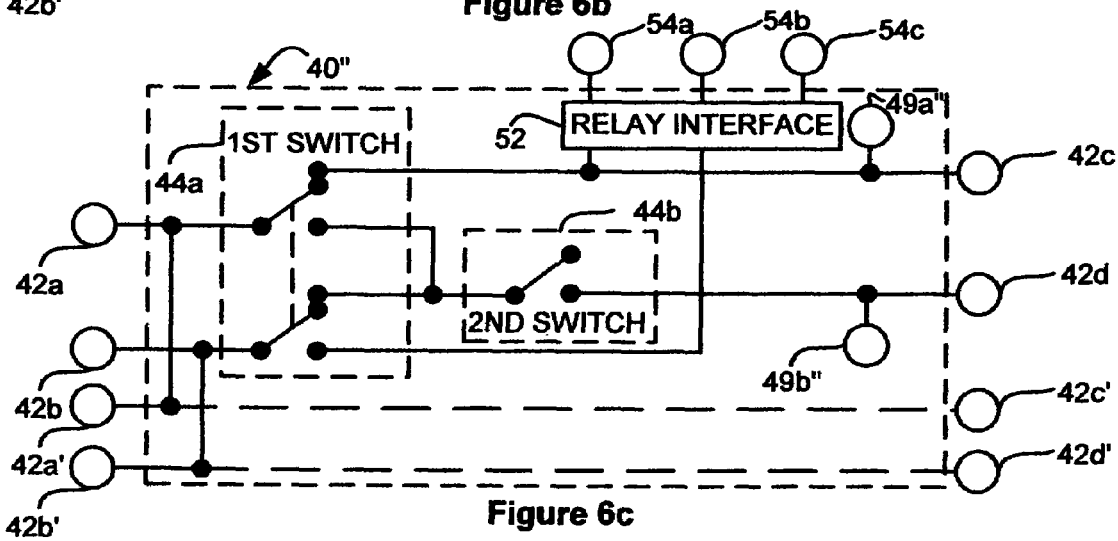
FIG. 6*c* is a schematic representation of another inventive adapter in accordance with a different alternative embodiment of the present invention.

A schematic representation of another alternative adapter 40" is shown in FIG. 6*c*. As shown therein, alternative adapter 40" includes a relay interface 52 and terminals 54*a,* 54*b* and 54*c*. Preferably, relay operational mode can be selected as either "normally open" or "normally closed" during installation of inventive adapter 40". Further, the position of relay interface 52 can preferably be remotely supervised to avoid accidentally jarring it out of position. Finally, if this variant of the invention is programmed to do so, it may be operated as a control relay. As shown, test points 49*a"* and 49*b"* are preferably located and operate in the same way as test points 49*a* and 49*b* of adapter 40 discussed above.

The substantial temporal and economic benefits of the present invention will now be illustrated via an economic analysis of a representative retrofit application. In a typical retrofit project performed in accordance with the prior art methods and apparatus, a building might have about 200 distributed zone-type detectors to be replaced and some additional control electronics to be upgraded at a central location. At an average of 15 minutes per detector and an average of $75.00 per hour for a technician, the zone-type detectors could be upgraded to addressable detectors in about 50 man-hours or $3750.00. Thus, a pair of technicians could complete this project in about three days. At an average cost of $15.00 per detector, the detectors would cost about $300.00 yielding a total cost for the detector portion of the project of $6750.00.

By contrast, the methods an apparatus of the present invention would cost far less, radically reduce the interference with use of the building and make technicians more available to complete other projects. Using the invention, the appropriate portions of each zone-type detector could be replaced with a corresponding addressable device in about 5 minutes and a project with 200 devices could be completed in about 16 man-hours. A pair of technicians could complete this task in a single day at a cost of about $1200.00, thereby saving about $2550.00. Further, since the present invention obviates the need to use a new addressable detector base, little no or additional cost for materials would be necessary. In addition to increasing availability of the technicians, the present invention radically reduces the time that operations at the subject building are interfered.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. An adapter for use with a zone-type detector base and an addressable detector, the zone-type detector base being affixed to a wired building and including a plurality of electrical terminals electrically connected to the wiring, the addressable detector having a plurality of electrical terminals, the adapter comprising:

a body having means for physically mating with the zone-type detector base and means for physically mating with the addressable detector;

a plurality of first electrical terminals positioned on the body and electrically connected to the electrical terminals of the base when the body is mated with the base; and a plurality of second electrical terminals positioned on the body and electrically connected to the electrical terminals of the detector when the body is mated with the detector, the first and second electrical terminals being electrically connected whereby at least some of the electrical terminals of the detector are electrically connected with the wiring when the body mates with the base and the detector.

2. The adapter of claim 1 further comprising means for selectively reversing the polarity of electricity received from at least some of the first electrical terminals and presented to at least some of the other first electrical terminals.

3. The adapter of claim 2 wherein the means for selectively reversing the polarity comprises a switch that is connected to at least some of the first electrical terminals and is accessible after the body has been mated with the base.

4. The adapter of claim 1 further comprising means for selectively disconnecting at least some of the first electrical terminals.

5. The adapter of claim 4 wherein the means for selectively disconnecting comprises a switch that may be accessible after the body has been mated with the base.

6. The adapter of claim 1 further comprising at least one test point electrically connected to at least one of the first adapter electrical terminals.

7. The adapter of claim 1 further comprising at least one test point electrically connected to at least one of the second adapter electrical terminals.

8. The adapter of claim 1 wherein the wiring is connected to additional zone-type bases and the adapter further comprising means for electrically isolating the addressable detector from the additional zone-type bases.

9. The adapter of claim 1 further comprising means for interfacing.

10. The adapter of claim 1 wherein the wiring is connected to additional zone-type bases and wherein the adapter further comprises:

means for electrically isolating the addressable detector from the additional zone-type bases;

means for selectively disconnecting at least one of the first electrical terminals; and means for selectively reversing the polarity of electricity presented to at least some of the first electrical terminals.

11. An adapter for use with a base and a detector, the base being affixed to a wired building and including a plurality of electrical terminals electrically connected to the wiring, the detector having a plurality of electrical terminals, the adapter comprising:

a body sized and shaped to physically mate with the base and the detector;

a plurality of first electrical terminals which are positioned on the body and electrically connected to the electrical terminals of the base when the body is mated with the base;

a plurality of second electrical terminals which are positioned on the body and electrically connected to the electrical terminals of the detector when the body is mated with the detector, wherein at least some of the first and second electrical terminals are electrically connected; and means, accessible after the body has been mated with the base, for selectively reversing the polarity of the electricity presented to at least some of the first electrical terminals.

12. The adapter of claim 11 further comprising a switch for selectively disconnecting at least one of the first electrical terminals, at least a portion of the switch being accessible after the body has been mated with the base.

13. The adapter of claim 11 wherein the means for selectively reversing the polarity comprises a single-pull double-throw switch.

14. The adapter of claim 11 wherein the wiring is connected to additional zone-type bases and the adapter further comprising means for electrically isolating the addressable detector from the additional zone-type bases.

15. The adapter of claim 11 further comprising a relay interface.

16. A method of replacing a zone-type detector with an addressable detector, the zone-type detector being attached to a legacy zone-type base affixed to a wired building and including a plurality of electrical terminals electrically connected to the wiring, the addressable detector having a plurality of electrical terminals, the method comprising:

removing the zone-type detector from the legacy zone-type base to thereby expose the legacy zone-type base;

mating an adapter with first and second electrical terminals with the exposed legacy zone-type base such that the first electrical terminals are connected to the base electrical terminals and such that the second electrical terminals are exposed; and mating the addressable detector with the adapter such that the electrical terminals of the addressable detector are electrically connected with the second electrical terminals.

17. The method of claim 16 further comprising reversing the polarity of electrical signals presented to at least some of the first electrical terminals after the step of mating an adapter.

18. The method of claim 16 further comprising disconnecting at least one of the first electrical terminals after the step of mating an adapter.

19. The method of claim 16 wherein mating an adapter occurs before mating the detector.

20. The method of claim 16 further comprising reversing the polarity of electrical signals presented to at least some of the first electrical terminals after the step of mating an adapter and before the step of mating the addressable detector.

* * * * *